United States Patent [19]

Wu

[11] Patent Number: 5,067,619

[45] Date of Patent: Nov. 26, 1991

[54] BUILT-UP CUP RACK

[76] Inventor: Chih-Cheng Wu, 3F., No. 568-2, Chingping Rd., Chung-Ho City, Taipei Hsien, Taiwan

[21] Appl. No.: 643,242

[22] Filed: Jan. 18, 1991

[51] Int. Cl.[5] ..... A47G 29/00

[52] U.S. Cl. ..... 211/71; 211/41; 108/29

[58] Field of Search ..... 211/71, 90, 153, 187, 211/186, 193, 41; 248/128; 108/24, 25, 108

[56] References Cited

U.S. PATENT DOCUMENTS

| | | | |
|---|---|---|---|
| 124,085 | 2/1872 | Richmond | 211/71 |
| 450,419 | 4/1891 | McIlhenny | 211/71 |
| 933,180 | 9/1909 | Johnson | 211/71 |
| 1,863,597 | 6/1932 | Handelan | 108/24 |
| 1,952,568 | 3/1934 | Schapp et al. | 108/24 X |
| 2,369,982 | 2/1945 | Richards | 211/71 X |
| 2,600,770 | 6/1952 | Hofacer | 211/71 X |
| 3,192,970 | 7/1965 | Allen | 211/71 X |

FOREIGN PATENT DOCUMENTS

| | | | |
|---|---|---|---|
| 627876 | 9/1961 | Canada | 211/71 |

*Primary Examiner*—Karen J. Chotkowski

*Attorney, Agent, or Firm*—Varndell Legal Group

[57] ABSTRACT

A built-up cup rack, comprising a cover board, a wall mounting board fastened in said cover board at the back through tongue-and-groove joint, and a plurality of hod-like cup holders transversely fastened in said cover board at the front through plug-in connection for holding cups of different size. Guide boards are obliquely mounted on the cover board to support the hod-like cup holders and guide the water therefrom a flow through a plurality of elongated slots on the cover board into a drain hole for discharging out of the rack.

3 Claims, 3 Drawing Sheets

BUILT-UP CUP RACK

BACKGROUND OF THE INVENTION

The present invention relates to cup racks, and more particularly to a built-up cup rack for holding cups which can be conveniently flexibly assembled according to the quantity of cups to be mounted.

In our daily life, cups of different type and material are frequently used for different purposes. Each time after service, a cup must be washed and dried to eliminate any possible contamination before it is used again. After water wash, according to conventional method, a cup is turned upside-down and put on a table for drying. According to this method, the moisture inside a cup is difficult to get dried and, and an odor may produce after a cup is sealed for a certain length of time. There is a kind of electric bowel dryer which may be used for drying cups. However, it consumes electric power and has can only dry a limited quantity of cups at a time. There are also various cup racks have been developed to eliminate the aforesaid problems. These conventional cup racks are still not practical in use since neither of which has means to guide water drops from the cups mounted thereon for drainage.

SUMMARY OF THE INVENTION

It is one object of the present invention to provide a built-up cup rack which can be conveniently assembled or dismantled.

It is another object of the present invention to provide a built-up cup rack which can be conveniently adjusted according to the quantity of shape of the cups to be mounted.

It is still another object of the present invention to provide a built-up cup rack which has an arrangement for draining the water from the cup mounted thereon.

DETAILED DESCRIPTION OF THE PREFERRED EMBODIMENT

Figure 1:
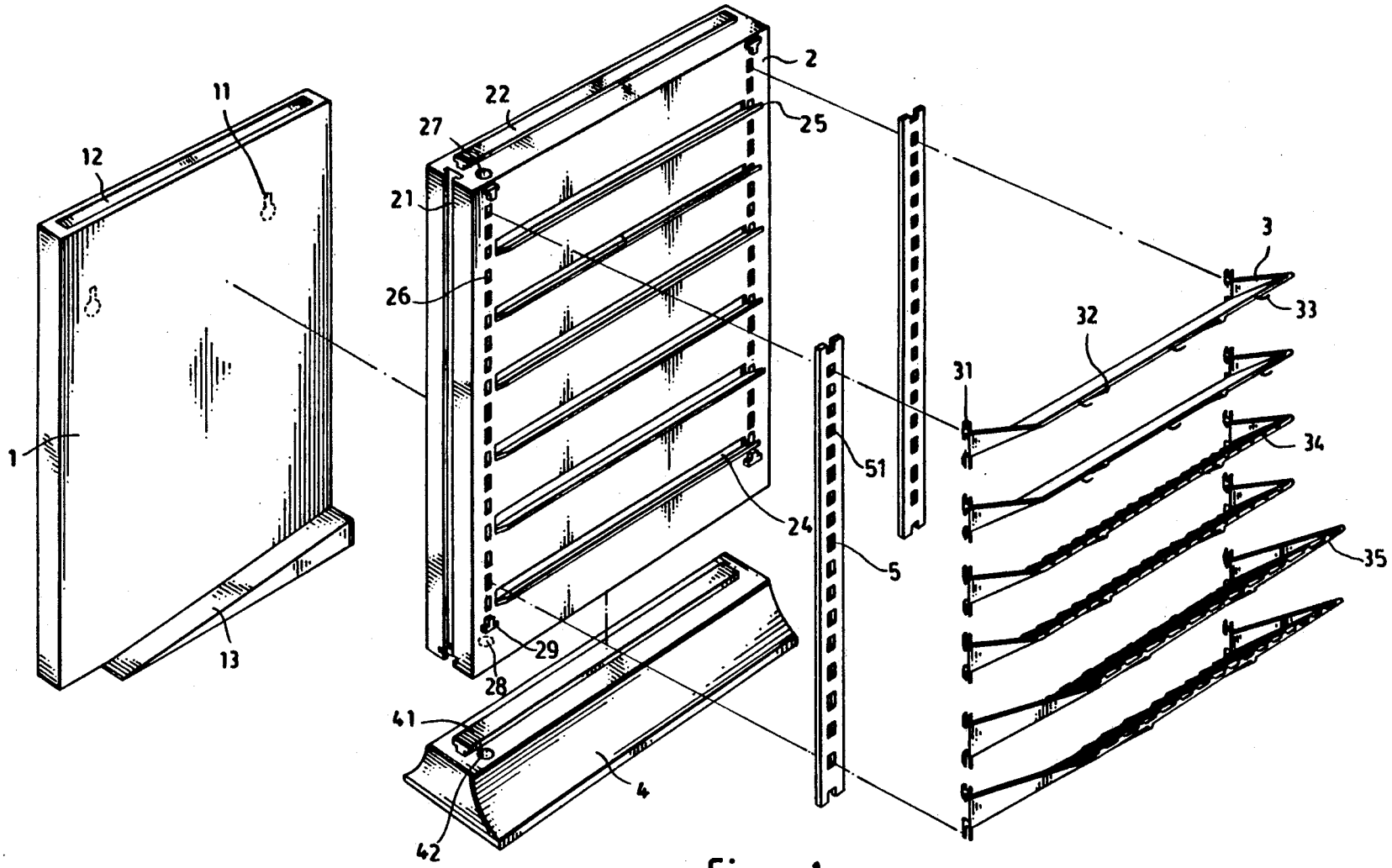
FIG. 1 is a perspective dismantled view of a built-up cup rack according to the present invention.
Figure 2:
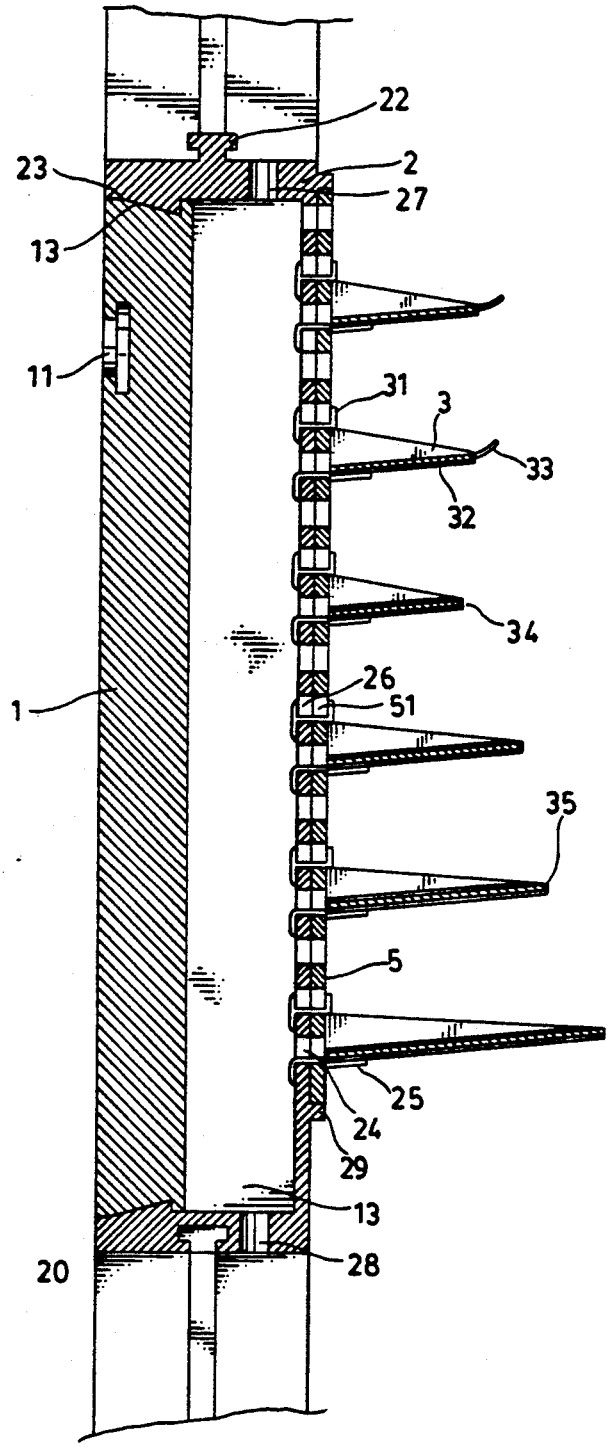
FIG. 2 is a partly sectional elevational view of the built-up cup rack of FIG. 1.

Referring to FIGS. 1 and 2, a built-up cup rack of the present invention which is generally comprised of at least a wall mounting board 1, at least a cover board 2, and a plurality of cup holders 3.

The wall mounting board 1 has two mounting holes 11 on the back side thereof, two elongated grooves 12 respectively made on the top and bottom ends thereof, and a bevel board 13 projecting from the bottom end thereof at one side.

The cover board 2 which defines therein a receiving space for holding the wall mounting board 1 comprises two elongated grooves 21 and two raised strips 22 respectively made on the four side edges thereof (by means of engaging the elongated groove of one cover board with the raised strip of another cover board, a plurality of cover boards can be connected together and longitudinally or transversely aligned), another two raised strips 23 on the inside at two opposite ends corresponding to the two elongated grooves 12 of the wall mounting board 1, a plurality of elongated slots 24 transversely piercing through the front surface thereof and spaced from one another at equal interval, a plurality of rectangular retaining holes 26 longitudinally disposed on the front surface thereof at two opposite sides, a plurality of guide plates 25 made on the front surface thereof and respectively disposed at the bottom of said elongated slots 24, four raised blocks 29 at the four corners of the front surface thereof for securing two reinforcing ribs 5 at the two opposite sides of the front surface thereof, and two round holes 27 and 28 vertically aligned and respectively piercing through the top and bottom ends thereof. The reinforcing ribs 5 have each a plurality of rectangular retaining holes 51 spaced from one another at interval equal to the interval between the rectangular retaining holes 26 on the front surface of the cover board 1.

The cup holder 3 is shaped like a hod, having two retainers 31 at two opposite ends for fastening in the rectangular retaining holes 26, a plurality of reinforcing stripes 32 on the bottom edge thereof, a plurality of hooks 33 on the front edge thereof for hanging cups, a corrugated surface portion 34 on the top edge thereof, and a plurality of raised strips 35 transversely disposed on the top edge thereof for holding the cups which are respectively mounted on the top edge thereof.

By engaging the raised strips 23 of the cover board 2 with the elongated grooves 12 of the wall mounting board 1, the wall mounting board 1 is firmly secured in the cover board 2. By fastening the retainers 31 in the retaining holes 51 of the reinforcing ribs 5 and the retaining holes 26 of the cover board 2, a plurality of cup holders 3 are secured to the cover board 2 and respectively supported by the guide plates 25. When cups which are just washed with water are respectively mounted on the corrugated surface portion 34 of the cup holders 3, water drops from the cups will be guided by the guide plates 25 to flow through the elongated slots 24 and further be guided by the bevel board 13 into the bottom round hole 28 of the cover board 2 for drainage. By means of the mounting holes 11, the assembly can be mounted on two nails fastened in a flat wall surface.

Referring to FIG. 1 again, a stand 4 may be provided for holding the assembly in plate. The stand has an elongated, raised strip 41 longitudinally disposed at the top, and a round hole 42 vertically piercing therethrough at one end. By engaging the elongated groove 21 at the bottom edge of the cover board 2 with the elongated, raised strip 41, the cover board 2 is firmly retained at the top of the stand 4 with the bottom round hole 28 vertically aligned with the round hole 42 of the stand 4 for drainage of water.

Figure 3:
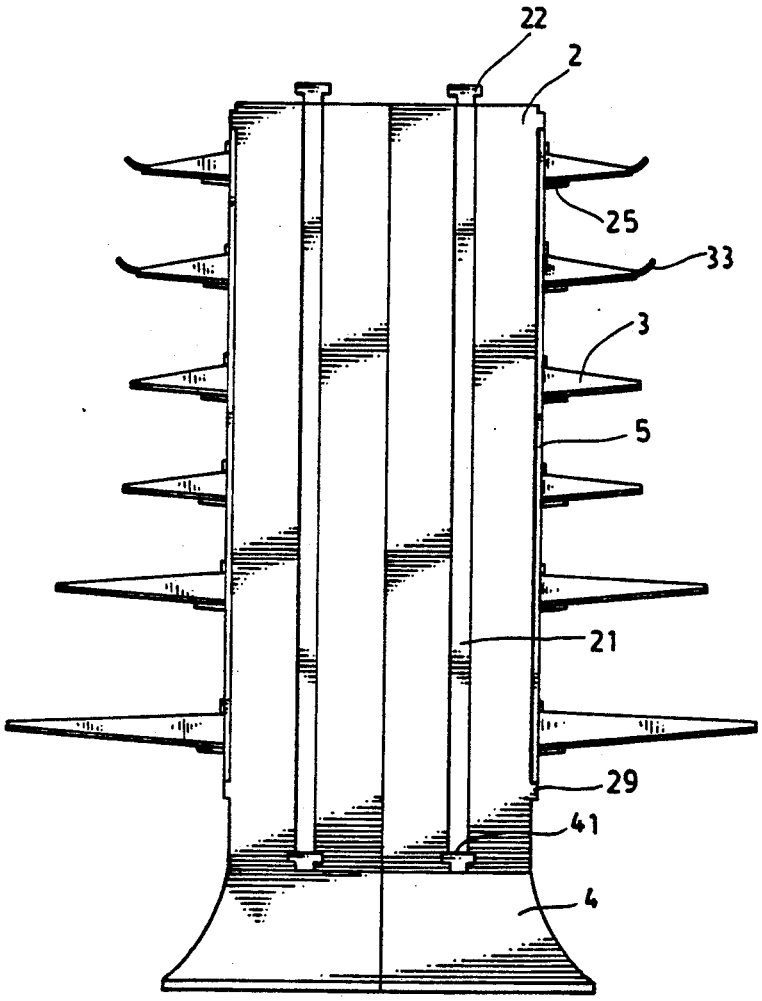
FIG. 3 illustrates an alternate form of the present invention.

Referring to FIG. 3, two cover boards 2 may be connected together back to back and respectively mounted on two stands 4 forming into an alternate structure of cup rack, as shown in FIG. 3, so that more cups can be mounted on this structure of cup rack at two opposite sides.

I claim:

1. A built-up cup rack, comprising:

a cover board in rectangular shape having a flat surface portion at the front, a recessed surface portion at the back and a four side edges around the periphery thereof, two elongated grooves made on two adjacent side edges thereof, two raised strips made on the other two adjacent side edges thereof, two projecting portions on said recessed surface portion at two opposite ends, a plurality of elongated slots transversely piercing through said flat surface portion and spaced from one another at equal interval, a plurality of retaining holes longitudinally disposed on said flat surface portion at two opposite sides, a plurality of guide plates respectively obliquely disposed at the bottom edge of said elongated slots, a drain hole at the bottom;

a wall mounting board fastened in said recessed back side, having nail mounting holes on the back side thereof for mounting said cover board on a wall surface, two elongated grooves respectively made on the top and bottom ends thereof for fastening said two projecting portions of said cover board, and a bevel board projecting from the bottom end thereof at one side for guiding water coming from said elongated slots to said drain hole for drainage; and a plurality of hod-like cup holders mounted on said flat surface portion and respectively supported by said guide plates for holding cups, having each two retainers at two opposite ends and respectively fastened in said retaining holes, and a plurality of reinforcing stripes at the bottom to reinforce the strength of the structure.

2. The built-up cup rack of claim 1, wherein said hod-like cup holders have each plurality of hooks on the front edge thereof for hanging cups, a corrugated surface portion on the top edge thereof or a plurality of raised parallel strips transversely disposed on the top edge thereof for holding cups of different size.

3. The built-up cup rack of claim 1, which further comprises a stand for supporting said cover board in position.

* * * * *